United States Patent [19]

Salvatore

[11] Patent Number: 4,996,815

[45] Date of Patent: Mar. 5, 1991

[54] PROCESS TO MANUFACTURE A SEAL-HOLDING PROFILE AND THE PROFILE OBTAINED FROM SAID PROCESS

[75] Inventor: Daniele Salvatore, Cusano Milanino, Italy

[73] Assignee: Italtel Tecnomeccanica s.p.a., Terni, Italy

[21] Appl. No.: 438,973

[22] Filed: Nov. 20, 1989

Related U.S. Application Data

[63] Continuation of Ser. No. 169,126, Mar. 9, 1989, abandoned, which is a continuation of Ser. No. 845,263, Feb. 14, 1986, abandoned.

[30] Foreign Application Priority Data

Jun. 14, 1984 [IT] Italy ..... 21405 A/84

[51] Int. Cl.[5] ..... E06B 1/00

[52] U.S. Cl. ..... 52/741; 52/656

[58] Field of Search ..... 52/656, 741; 29/155 R

[56] References Cited

U.S. PATENT DOCUMENTS

| | | | |
|---|---|---|---|
| 1,005,249 | 10/1911 | Lunken | 52/656 |
| 1,039,370 | 9/1912 | Ellis et al. | 52/656 |
| 2,097,484 | 11/1937 | Winslow | 52/656 |
| 2,679,665 | 6/1954 | Beard | 52/656 |
| 3,336,715 | 8/1967 | Savary | 52/656 |
| 3,514,915 | 6/1970 | Johnson | 52/363 |
| 3,522,684 | 10/1987 | Grossman . | |
| 3,689,970 | 9/1972 | Falkner | 29/155 R |

FOREIGN PATENT DOCUMENTS

| | | | |
|---|---|---|---|
| 1452629 | 4/1969 | Fed. Rep. of Germany | 29/155 R |
| 2233471 | 1/1974 | Fed. Rep. of Germany . | |
| 2421918 | 11/1975 | Fed. Rep. of Germany | 29/155 R |

*Primary Examiner*—David A. Scherbel
*Assistant Examiner*—Deborah McGann Repley

[57] ABSTRACT

A process designed to make it possible to manufacture a seal-holding profile, meant especially for the panels of industrial cabinets forms the profile from the same piece of plate metal as the cabinet sidewalls. The profile obtained from this process is also described. The edges of the sheet of metal with which the panels are made are shaped in such a manner that they have a first (4), a second (5) and a third portion (6) reciprocally positioned according to predetermined directions. The sheet of metal thus shaped is subjected to a pressing operation exercised between the wall of the panel next to the profile and the said third portion.

4 Claims, 2 Drawing Sheets

PROCESS TO MANUFACTURE A SEAL-HOLDING PROFILE AND THE PROFILE OBTAINED FROM SAID PROCESS

This application is a continuation, of application Ser. No. 07/169,126 filed on Mar. 9, 1989, now abandoned, which is a continuation of application Ser. No. 06/845,263 filed on Feb. 14, 1986, now abandoned.

FIELD OF THE INVENTION

The present invention is directed to a process for manufacturing a seal-holding profile for use in the field of industrial cubicles or the like, and to the profile obtained from the process.

BACKGROUND OF THE INVENTION

Conventionally, industrial cubicles are formed of a supporting structure, the shape and size of which substantially corresponds to the desired size of the cubicle to be made, which is then covered with panels that are fixed to the supporting structure.

Due to the fact that the equipment contained in said cubicles frequently has to be preserved from dust and sprays of liquid, a seal designed to guarantee sealing against these factors is usually interposed between the edges of the panels and the support structure. In particular, the seal is usually fixed to the panels as it is positioned inside a profile fixed along each of their edges. According to some known solutions, the profile is made by means of a metallic element shaped in such a manner as to form a groove together with the edges of the panels, in which a stem of the seal will be positioned. The metallic element is usually fixed to the panel by means of welding.

Such solutions are undesirable due to their expense as it is necessary to manufacture the shaped element and then carry, out the welding operations. Furthermore, this solution makes it necessary to store and "manage" both the panels and the shaped elements, and in industrial production such operations have a cost that affects the cost of the structure as a whole.

In the same way, manufacturing processes for seal-holding profiles for products other than industrial cubicles are also well known, that make it possible to avoid the above mentioned inconveniencies, as they make it possible to obtain the said profile from the same sheet of metal with which the panels are made, and as a consequence the problems of welding and "management" mentioned above no longer exist. However, the said known processes are applicable exclusively in the case that the sheet metal has a thickness of less than one millimeter, as the said profile is obtained with these proceses by means of bending.

On the other hand it must be kept in mind that the coating panels of industrial cubicles must have certain strength characteristics that can be obtained only through the use of sheet metal having more than one millimeter of thickness. As the production of the profiles from the same sheet of metal as the panels is achieved by bending the metal nearly 180°, it is evident that the processes of the known type cannot be applied to the field of panels for industrial cubicles due to the technical problems which arise from trying to bend, to the above mentioned degree, sheet metal of the aforementioned thickness.

SUMMARY OF THE INVENTION

Therefore, it is an object of the present invention to produce a process for manufacturing a seal-holding profile obtained from the same sheet of metal as that constituting the panel, designed to make it possible to overcome the above mentioned technical problems.

The process, according to the invention, includes the performance, in sequence, of:

shaping the edges of the same sheet of metal as the panels are made of by preforming each edge in such a manner that it has a first portion arranged at an angle of more than 90° to the extension of the panel wall next to the profile, a second portion arranged at an angle of 90° to the aforesaid panel wall, a third portion arranged at an angle between 0° and 90° to the second portion;

pressing the panel wall next to the profile and the said third portion together, until the first and the third portion are positioned parallel with respect to the abovementioned panel wall.

The seal-holding profile obtained according to the aforementioned process is made up of an element, the cross section of which is shaped like a groove and has one of the sides of the said groove positioned parallel to the wall of the panel carrying the said profile and is in physical continuity with the edge of the said wall.

A seal-holding profile shaped as described above has the advantage, with respect to the said profiles obtained by welding preformed elements onto the panels, that the edge of the panel is stengthened remarkably by the presence of the said side of the groove. In fact, the side of the groove substantially doubles the thickness of the material with which the panel is made in the area adjacent the groove. As the seal-holding profile constitutes a single piece together with the panel, from an industrial point of view it is not necessary to separately "manage" the seal-holding profile.

Whilst carrying out the aforementioned process it is possible to work in such a manner that a space remains between the said side of the groove and the wall of the panel that is sufficiently large to allow paint or other materials for superficial treatment to penetrate into the said cavity thus also preserving said areas from corrosion. The said cavity seems difficult to create using the known type of process.

BRIEF DESCRIPTION OF THE DRAWINGS

Further characteristics of the invention will be made evident by the following description which refers to an example of production that is in no way intended to be limiting, and is completed by the attached diagrams in which.

DETAILED DESCRIPTION OF THE PREFERRED EMBODIMENTS

Figure 1:
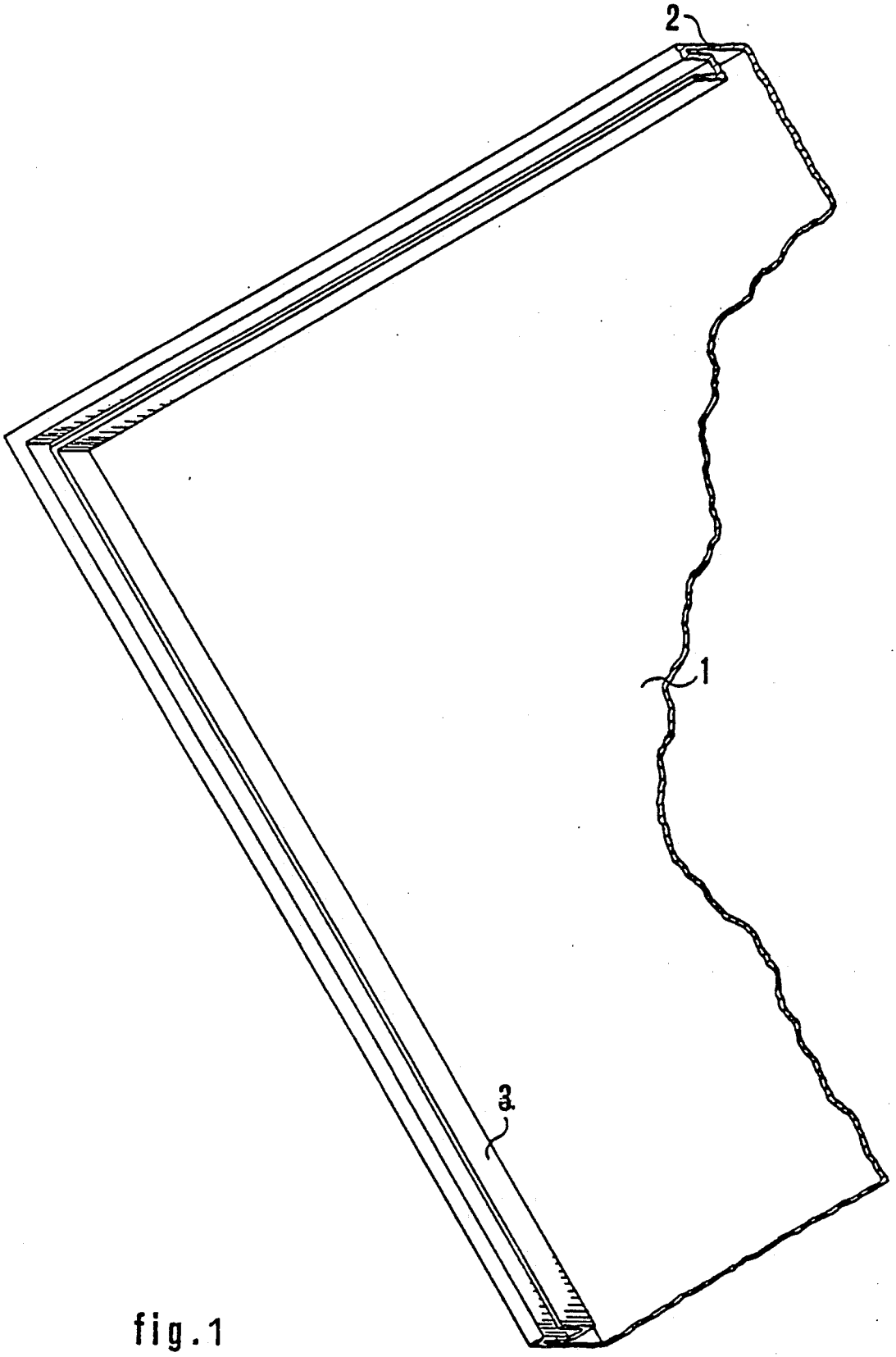
FIG. 1 shows a portion of a panel complete with the seal-holding profile produced according to the invention.

In FIG. 1 a portion of the largest surface face of a panel that may be used for example to cover the structures of industrial cubicles has been indicated with the number 1. The sides of said face are usually bent at right angles in order to strengthen the panel and give it both aesthetic and functional qualities. The edges of the said smaller surface faces 2 will come into contact with the supporting structure of the cubicles and, for the sealing reasons given above, a seal must be applied to said edges which in turn must be supported by a profile 3. In this FIG. the profile made according to the invention is illustrated.

The invention includes making the said profile from the same sheet of plate metal as the panels are made from and seeing as the said sheet metal must have a thickness of not less than one millimeter (and preferably of 1.5–2.0 mm.), the profile cannot be made by simple bending operations.

Figure 2:
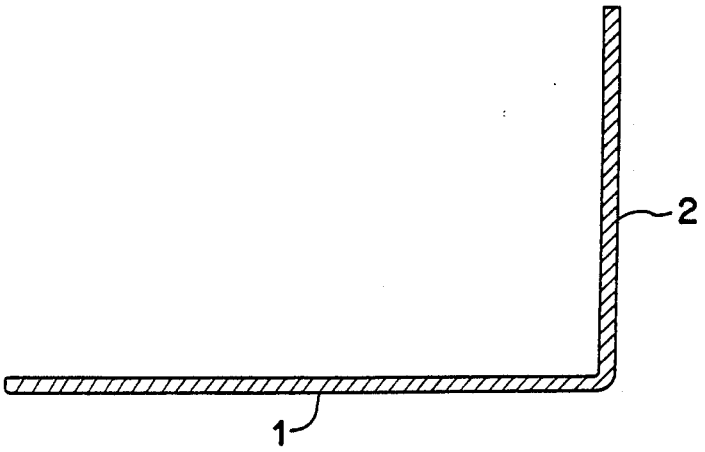
FIG. 2 shows the sequence of operations upon which the process of the present invention is founded.
Figure 2:
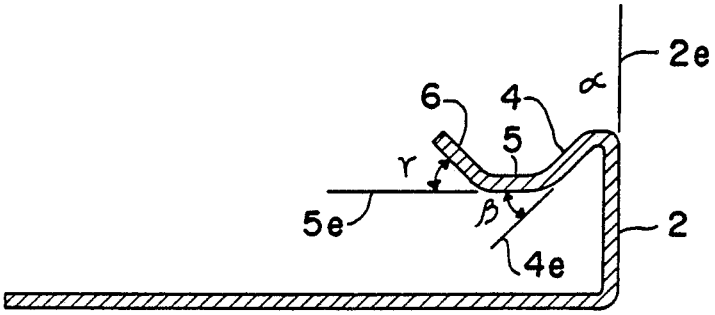
Figure 2:
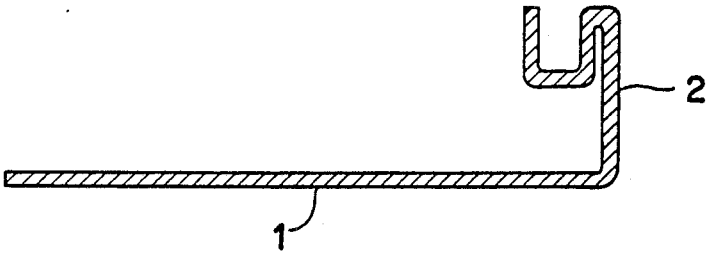
Figure 2:
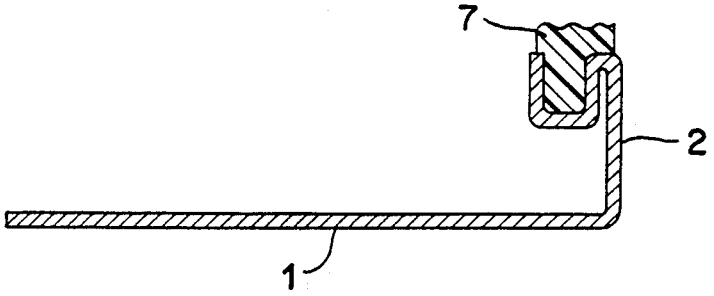

According to the present invention, the profile is made by following the process illustrated in FIG. 2 wherein the letter (a) has been used to indicate a normal working phase to produce panels by bending the edges of the said larger surface 1 in order to obtain the said smaller surface face 2.

The portion of sheet metal with which the smaller surface face is made is sufficient however to make it possible to also make the seal-holding profile out of it.

After the working phase (a) has been completed, working phase (b) must also be carried out, in which the portion of the sheet metal with which the seal-holding profile will be made is subjected to a shaping operation that can be carried out through bending or profiling. In particular the said operation includes the shaping of the said portion of sheet metal by bending or profiling through an angle with respect to its original unbent extension in such a way as to have:

a first portion 4 positioned at an angle $\alpha$ of more than 90° to the extension $\beta$ where $\beta=\alpha-90$ with respect to one extension 4*e* of the first portion 4, thus extending 2*e* of the said smaller surface face 2;

a second portion 5 positioned at an angle with respect to the aforementioned face 2;

a third portion 6 arranged at an angle 2 of between 0° and 90° to an extension the said 5*e* of second portion 5.

Once the shaping operations have been carried out, a pressing operation must be carried out that is exercised between the said smaller surface face 2 and the said third portion 6, until the first and the third portions are more or less parallel with respect to the said smaller surface face.

In the working phase (c) the seal-holding profile obtained from the operations described above is illustrated and it can be observed that it is made up of a groove shaped element that has one of the sides 4 of the groove situated parallel to the smaller surface face 2; the edge of the said side constitutes a continuation of the edge of the said face 2.

In the working phase (d) the profile described above and complete with its relative seal 7 is illustrated. In fact this seal 7 has a stem, the dimensions of which more or less coincide with those of the said groove, thus it is firmly held in the profile and it is impossible for the seal 7 to slip out of the groove when not desired.

The seal-holding profile shaped as described above, besides having a low production cost, also adds a concrete advantage to the panels themselves as it strengthens the edge of the said smaller surface face remarkably. In fact, in that area the thickness of the material is doubled by the presence of the groove.

During the pressing operation it is possible to create a cavity between the said first portion 4 and the said face 2 of such dimensions as to allow paint or other materials for treating surfaces to penetrate inside the same and thus treat the said area in order to preserve it from corrosion. From an industrial point of view, seeing as the seal-holding profile constitutes one single piece together with the panel, it is not necessary to "manage" it separately, as described in the aim of the invention.

I claim:

1. A process to manufacture a seal holding profile for panels of industrial cabinets comprising the steps of:

(a) bending a panel to form a larger surface face and a smaller surface face substantially at right angles to one another;

(b) shaping said smaller surface face further comprising the sequential steps of:

(i) bending a portion of said smaller surface face into a first portion forming an angle, $\alpha$, which is substantially greater than 90 degrees and less than 180 degrees with respect to said face;

(ii) bending a portion of said first portion into a second portion forming an acute angle, $\beta$, with respect to said first, substantially equal to $(\alpha-90)$ degrees;

(iii) bending a portion of said second portion into a third portion forming an acute angle, $\alpha$, with respect to said second portion, substantially equal to said angle $\beta$; and, (iv) pressing said smaller surface face and said third portion toward each other until said first and third portions are generally in parallel relationship with said smaller surface face and forming a U-shaped groove.

2. The process of claim 1 further comprising the step of providing a seal in said U-shaped groove.

3. A process to manufacture a seal holding profile for panels of industrial cabinets comprising the step of:

(a) shaping a face of said panels which further comprises the sequential steps of:

(i) bending a portion of said face into a first portion forming an angle, $\alpha$, which is substantially greater than 90 degrees and less than 180 degrees with respect to said face;

(ii) bending a portion of said first portion into a second portion forming an angle, with respect to said face, substantially equal to 90 degrees;

(iii) bending a portion of said second portion into a third portion forming an acute angle, $\alpha$, with respect to said second portion, substantially equal to said $(\alpha-90)$ degrees; and, (iv) pressing said face and said third portion together until said first and third portions are substantially parallel with respect to said face and forming a U-shaped seal holding profile.

4. The process of claim 3 further comprising the step of providing a seal in said U-shaped seal holding profile.

* * * * *